United States Patent [19]

Takeda et al.

[11] 4,262,270

[45] Apr. 14, 1981

[54] ELECTROMAGNETIC RELAY SWITCH ASSEMBLY

[75] Inventors: Nobuhiro Takeda; Masaichi Hattori; Shigeo Mizuno, all of Nagoya, Japan

[73] Assignee: Kabushiki Kaisha Tokai Rika Denki Seisakusho, Nishi, Japan

[21] Appl. No.: 72,849

[22] Filed: Sep. 6, 1979

[30] Foreign Application Priority Data

Sep. 14, 1978 [JP] Japan ..... 53-125355[U]

[51] Int. Cl.[3] ..... H01H 67/06

[52] U.S. Cl. ..... 335/123; 335/140

[58] Field of Search ..... 335/121, 123, 124, 140

[56] References Cited

U.S. PATENT DOCUMENTS

| | | | |
|---|---|---|---|
| 3,388,360 | 6/1968 | Parisoe | 335/123 X |
| 3,448,420 | 6/1969 | Lotspeich et al. | 335/123 X |
| 3,914,725 | 10/1975 | Williamson | 335/140 |
| 4,151,496 | 4/1979 | Imai et al. | 335/123 X |

*Primary Examiner*—George Harris

*Attorney, Agent, or Firm*—Wenderoth, Lind & Ponack

[57] ABSTRACT

An electromagnetic relay switch assembly comprises, in combination, an electromagnetic coil, a movable plate of magnetizable material supported for pivotal movement between attracted and released positions, a drive wheel including a pawl member and being rotatable reciprocately in response to the movement of the movable plate, a carrier wheel having a detent gear and a ratchet gear. Each time the movable plate is moved from the released position to the attracted position, the carrier wheel is stepwisely rotated in one direction by the pawl member engaged to any one of the ratchet gear teeth. A detent pawl for avoiding the reverse rotation of the carrier wheel and a positioning member for accurately positioning the carrier wheel are also provided.

5 Claims, 4 Drawing Figures

ELECTROMAGNETIC RELAY SWITCH ASSEMBLY

BACKGROUND OF THE INVENTION

The present invention relates to an electromagnetic relay switch assembly.

Various types of electromagnetic relay switch assemblies are currently commercially available. In general, the prior art electromagnetic relay assemblies comprises an electromagnet unit including an electromagnetic coil means, a movable plate member of a magnetizable material supported for pivotal movement between attracted and released positions, a ratchet wheel and means for stepwisely rotating the ratchet wheel in response to the movement of the movable plate member from the released position to the attracted position. A detent mechanism for assuredly achieving the stepwise rotation of the ratchet wheel is also utilized and is generally employed in the form of a leaf spring having one end fixed and the other end engaged to the ratchet wheel.

Although the prior art electromagnetic relay switch assemblies operate satisfactorily and effectively, the purpose for which they are utilized is limited. This is because the leaf spring forming a part of the detent mechanism exerts such a relatively large resiliency as to provide a resistance to the pivotal movement of the movable plate member from the released position towards the attracted position while the return biasing force necessary to bias the movable plate member to the released position acts on the movable plate member.

In order to overcome this resistance, the electromagnetic coil means utilized in the prior art electromagnetic relay switch assemblies must be of such a design that, when it is energized, it can exert a magnetic attractive force sufficient to overcome the sum of the resiliency of the leaf spring and the return biasing force.

SUMMARY OF THE INVENTION

Accordingly, the present invention has been developed in view to substantially eliminating the above described disadvantages and inconveniences inherent in the prior art electromagnetic relay switch assemblies and has for its essential object to provide an improved electromagnetic relay switch assembly which does not require the use of an electromagnetic coil of a relatively large size.

Another object of the present invention is to provide an improved electromagnetic relay switch assembly which can be manufactured without incurring the increased cost.

A further object of the present invention is to provide an improved electromagnetic relay switch assembly which can readily respond to the application of an electric current to the electromagnetic coil.

A still further object of the present invention is to provide an improved electromagnetic relay switch assembly which can readily be assembled with no substantial difficulty.

BRIEF DESCRIPTION OF THE DRAWINGS

These and other objects and features of the present invention will become apparent from the following description taken in conjuction with a preferred embodiment thereof with reference to the accompanying drawings, in which.

DETAILED DESCRIPTION OF THE INVENTION

Figure 1:
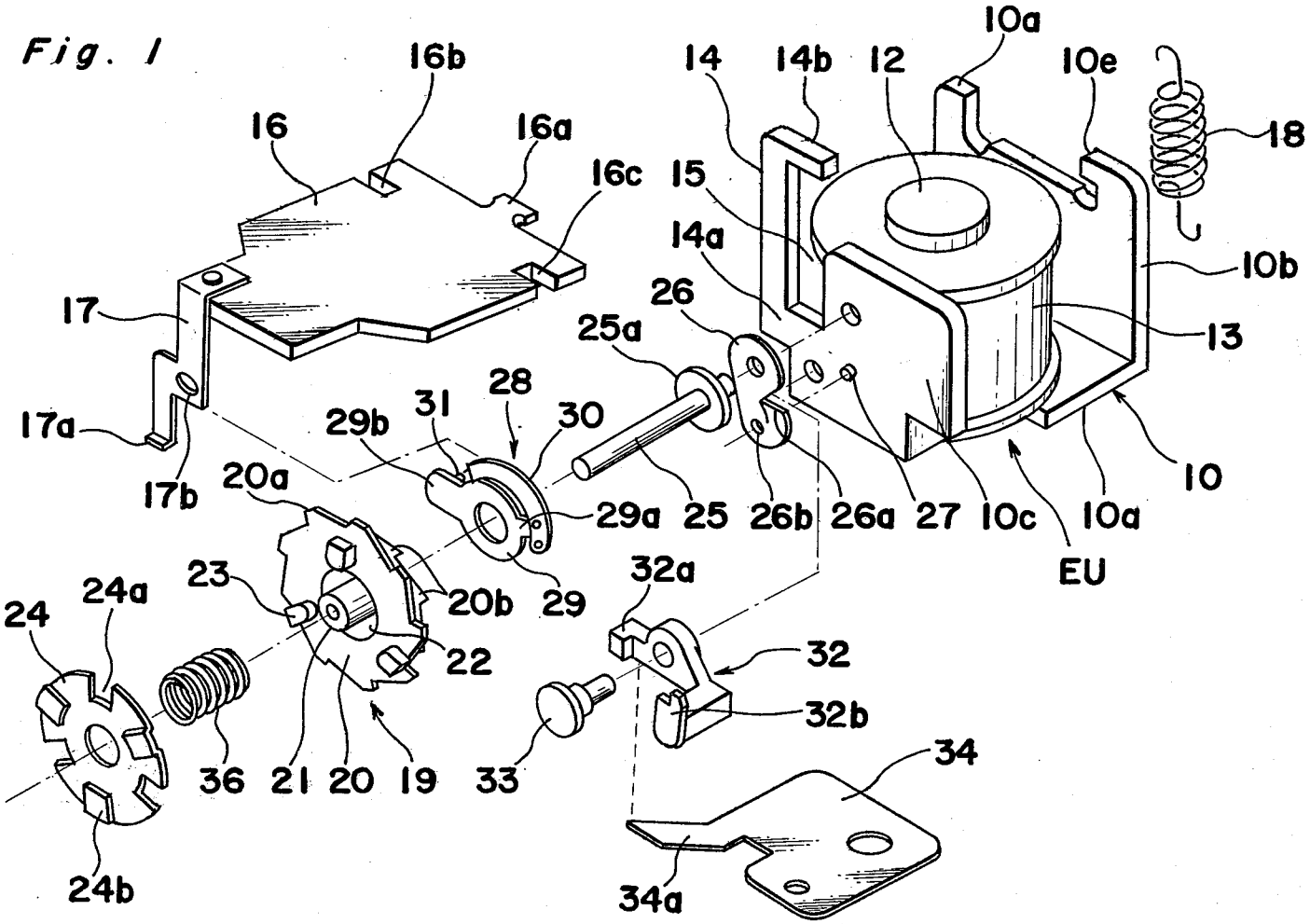
FIG. 1 is an exploded view of an electromagnetic relay switch assembly embodying the present invention.

Before the description of the present invention proceeds, it is to be noted that like parts are designated by like reference numerals throughout the accompanying drawings.

Referring to the accompanying drawings, an electromagnetic relay switch assembly embodying the present invention comprises an electromagnet unit generally identified by EU and including a generally U-shaped yoke member 10 rigidly mounted on a support plate 11 and carrying an iron core 12 in a manner as will be described later. The yoke member 10 is made of a magnetizable material and has a base 10*a*, held in contact with the support plate 11, and a pair of opposed upright walls 10*b* and 10*c* extending respectively from the opposed ends of the base 10*a* in the same direction at right angles to the base 10*a*. The iron core 12, made of a magnetizable material, extends from the base 10*a* at right angles thereto with one end thereof rigidly connected, or otherwise staked, to the base 10*a* and has an electromagnetic coil 13 wound therearound and positioned substantially intermediate between the upright walls 10*b* and 10*c*.

The upright wall 10*b* is integrally formed at its free end remote from the base 10*a* with a pair of spaced fingers 10*d* and 10*e*, the finger 10*e* being so shaped as to overhang a portion of the free end of the upright wall 10*b* by the reason which will become from the subsequent description. On the other hand, the upright wall 10*c* has a generally U-shaped guide arm 14 having one end 14*a* integrally formed with, or otherwise rigidly connected to, a lateral side portion of the upright wall 10*c* and the other end 14*b* positioned above and overhanging the free end of the upright wall 10*c*, thereby leaving an elongated guideway 15 between the U-shaped guide arm 14 and the upright wall 10*c*.

The electromagnet unit EU also includes a generally rectangular movable plate 16 made of an magnetizable material and supported by the yoke member 10 in a manner as will be described later for pivotal movement between attracted and released positions. As best shown in FIG. 1, the movable plate 16 has one end formed with an engagement 16*a* protruding outwards therefrom at a position substantially intermediately of the width of the plate 16, and also a pair of engagement recesses 16*b* and 16*c* each extending inwardly from a corresponding side portion of the plate 16 adjacent the engagement 16*a*.

The movable plate 16 carries an elongated actuating member 17 having one end rigidly connected to the other end of the movable plate 16 and the other end formed integrally with an abutment 17*a*, a substantially intermediate portion of said actuating member 17 extending in a direction at right angles to the movable plate 16. The movable plate 16 so constructed as hereinbefore described is pivotally mounted on the free end of the upright wall 10*b* with the engagement recesses 16*b* and 16*c* loosely receiving therein the respective fingers 10*d* and 10*e* and also with the engagement 16*a* protruding from the upright wall 10*b* in a direction opposite to the upright wall 10*c*. In this assembled condition, the end 14*b* of the U-shaped guide arm 14 partially overhangs the movable plate 16 to define the released position of the movable plate 16.

Figure 3:
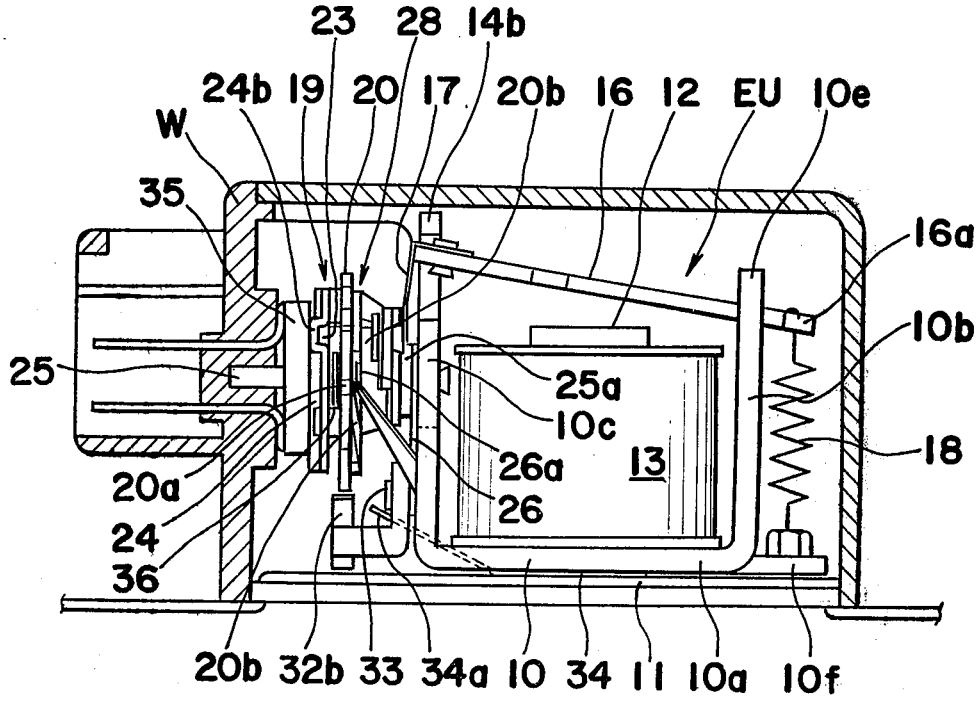
FIG. 3 is a side view, with a housing shown in section, of the electromagnetic relay switch assembly shown in FIG. 1.

A biasing spring element 18, for example, a tension spring, is suspended between the engagement 16*a* and a hook 10*f* fast with the yoke member 10 for biasing the movable plate 16 to assume the released position with the end of the movable plate 16 adjacent the actuating member 17 held in contact with the end 14*b* of the U-shaped guide arm 14 as best shown in FIG. 3.

In the construction so far described, it will readily be seen that, when the electromagnetic coil 13 is energized, the movable plate 16 is attracted towards the iron core 12 by the action of an electromagnetism in a manner known to those skilled in the art, thereby pivoting against the biasing spring element 18 from the released position towards the attracted position.

The electromagnetic relay switch assembly further comprises a carrier wheel 19 including a disc body 20 having its periphery formed with a plurality of, for example, nine, detent gear teeth 20*a* protruding radially outwards therefrom and circumferentially equally spaced from each other. This disc body 20 is also formed on one of the opposed surfaces thereof with ratchet gear teeth 20*b* equal in number to the number of the detent gear teeth 20*a* and arranged in a circle coaxial with the disc body 20, said ratchet gear teeth 20*b* protruding axially outwards from the disc body 20 and circumferentially equally spaced from each other.

The disc body 20 has a circular recess extending from the other of the opposed surfaces thereof and terminating substantially halfway the thickness of the disc body 20, and a bearing sleeve 21 having one end integral and fast with the bottom of the circular recess in the disc body 20 and the other end terminating outside the other of the opposed surfaces of the disc body 20, a substantially intermediate portion of said bearing sleeve 21 extending through and coaxially of the circular recess. The outer diameter of the bearing sleeve 21 is so much smaller than the diameter of the circular recess in the disc body 20 that an annular groove 22 can be defined between the outer peripheral surface of the bearing sleeve 21 and the wall defining the circular recess in the disc body 20.

The surface of the disc body 20 opposite to the ratchet gear teeth 20*b* is formed with a plurality of, for example, three, circumferentially equally spaced guide blocks 23 each protruding outwards therefrom, which guide blocks 23 are utilized to support a movable contact disc 24 for rotation together with the carrier wheel 19 in a manner as will be detailed later.

The carrier wheel 19 of the construction described above is rotatably mounted on a bearing shaft 25 having one end formed with a radially outwardly extending flange 25*a* and rigidly connected, or otherwise staked, to the upright wall 10*c* of the yoke member 10 and the other end inserted in a wall member W (best shown in FIGS. 3 and 4) forming a part of a housing structure for the electromagnetic relay switch assembly, a substantially intermediate portion of said bearing shaft 25 extending through the bearing sleeve 21 to support the carrier wheel 19 for rotation about the longitudinal axis thereof. Mounted on the bearing shaft 25 and positioned between the flange 25*a* and the upright wall 10*c* is a detent member 26 having an elastic pawl 26*a* defined therein and protruding outwards from the plane of the detent member 26 in a direction opposite to the upright wall 10*c*, said pawl 26*a* being engageable with any one of the ratchet gear teeth 20*b*. This detent member 26 is held in position by a pin 27 fast with the upright wall 10*c* and engaged in a hole defined at 26*b* in the detent member 6 so that the detent member 26 will not rotate about the longitudinal axis of the bearing shaft 25.

Rotatably mounted on the bearing shaft 25 and positioned between the flange 25*a* and the carrier wheel 19 is a drive wheel 28. This drive wheel 28 is comprised of an annular body 29 mounted on the bearing shaft 25 and having a pair of generally opposed arms 29*a* and 29*b* protruding radially outwards therefrom and includes a substantially arcuate elastic pawl 30 having one end rigidly connected to the arm 29*a* and the other end engaged with any one of the ratchet gear teeth 20*b* at a position generally opposed to the position where the pawl 26*a* is engaged with any one of the ratchet gear teeth 20*b*, a substantially intermediate portion of said arcuate pawl 30 extending over a portion of the outer periphery of the annular body 29 and so twisted slightly as to enable said other end thereof to engage any one of the ratchet gear teeth 20*b*. The arm 29*b* has a pin 31 rigidly carried thereby and protruding therefrom in a direction parallel to the bearing shaft 25, said pin 31 being so engaged in a hole 17*b* defined in the actuating member 17 that the movement of the movable plate 16 between the attracted and released positions can be transmitted to the drive wheel 28 to rotate the latter about the bearing shaft 25.

In the construction so far described, it will readily be seen that, each time the movable plate 16 is pivoted from the released position to the attracted position under the influence of the magnetic attractive force developed when the electromagnetic coil 13 is energized, the drive wheel 28 is rotated in a first direction about the bearing shaft 25 with the arcuate pawl 30 causing the carrier wheel 19 to rotate in one direction about the bearing shaft 25 through an angular distance equal to the pitch between every adjacent two of the ratchet gear teeth 20*b*. At this time, the pawl 26*a* of the detent member 26 slides over one of the ratchet gear teeth 20*b* during the rotation of the carrier wheel 19 in one direction and, when the carrier wheel 19 completes its stepwise rotation through said angular distance, it falls onto the next adjacent one of the ratchet gear teeth 20*b*, thereby preventing the carrier wheel 19 from being rotated in a direction opposite to said one direction. In other words, while the arcuate pawl 30 serves to rotate the carrier wheel 19 stepwisely, the pawl 26*a* serves to avoid any possible reverse rotation of the carrier wheel 19 which would take place as the drive wheel 28 is rotated in a second direction opposite to the first direction incident to the movement of the movable plate 16 from the attracted position back to the released position.

In order to accurately position the carrier wheel 19, the electromagnetic relay switch assembly embodying the present invention further comprises a positioning member 32 supported at its substantially intermediate portion to the upright wall 10*c* by means of a rivet 33 for pivotal movement between inoperative and operative positions about the longitudinal axis of the rivet 33. The positioning member 32 has one end 32*a* engageable to the abutment 17*a* of the actuating member 17 and the other end integrally formed with a finger 32*b* engageable with any one of the detent gear teeth 20a in the carrier wheel 19.

Figure 2:
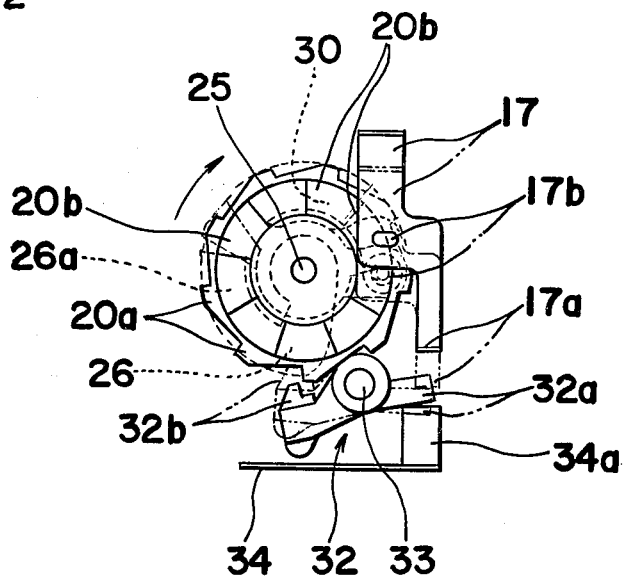
FIG. 2 is an end elevational view of an essential portion of the electromagnetic relay switch assembly shown in FIG. 1.

Rigidly secured to the base 10a of the yoke member 10 and sandwiched between the yoke member 10 and the support plate 11 is a base plate 34 having a leaf spring portion 34a integrally formed therewith, the tip of said leaf spring portion 34a being held in contact with the end 32a of the positioning member 32. By the action of the resiliency exerted by the leaf spring portion 34a of the base plate 34 which is transmitted to the positioning member 32 through the engagement between the tip of the leaf spring portion 34a and the end 32a of the positioning member 32, the latter is normally biased to assume the inoperative position in which condition the finger 32b on the other end of the positioning member 32 is separated from any one of the detent gear teeth 20a as shown by the solid line in FIG. 2.

Figure 4:
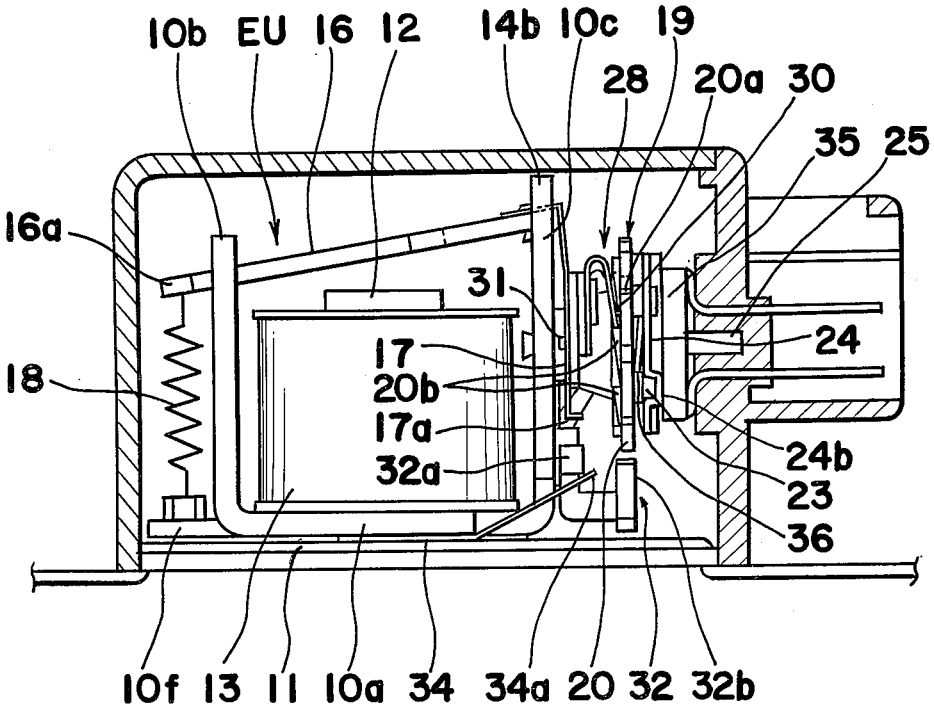
FIG. 4 is a view similar to FIG. 3, showing the electromagnetic relay switch assembly as viewed from the direction opposite to that shown in FIG. 3.

As best shown in FIGS. 1, 3 and 4, the movable contact disc 24, made of an electroconductive material, has bearing recesses 24a equal in number to the number of the guide blocks 23 on the carrier wheel 19 and so shaped as to receive therein the corresponding guide blocks 23. Accordingly, the movable contact disc 24 is stepwisely movable together with the carrier wheel 19. The movable contact disc 24 is also formed with a plurality of, for example, three, contact projections 24b circumferentially equally spaced from each other. The contact projections 24b are selectively engageable to a corresponding number of fixed contacts (not shown) carried by a terminal member 35 secured to the wall member W in any suitable manner, from which fixed contacts respective terminal members extend through the wall member W to the outside of the housing structure. To ensure an exact electric contact between the contact projections 24b and the fixed contacts on the terminal member 35, the movable contact disc 24 is normally biased in a direction away from the carrier wheel 19 and towards the terminal member 35 by the action of a compression spring 36 loosely mounted on the sleeve 21 and positioned between the carrier wheel 19 and the movable contact disc 24.

So far illustrated, the fixed contacts on the terminal member 35 are electrically connected together through the movable contact disc 24 when the contact projections 24b are brought in contact with such fixed contacts on the terminal member 35. However, depending upon the purpose for which the electromagnetic relay assembly embodying the present invention is utilized, any suitable combination of movable contacts and fixed contacts for a switch arrangement can be employed.

The electromagnetic relay assembly of the construction described above operates in the following manner.

When the electromagnetic coil 13 is energized, the movable plate 16 is attracted by the iron core 12, pivoting from the released position towards the attracted position against the tension spring 18. As the movable plate 16 pivots towards the attracted position, the actuating member 17 causes the drive wheel 28 to rotate in the first direction about the bearing shaft 25 with the arcuate pawl 30 causing the carrier wheel 19 to rotate in the same direction as the direction of rotation of the drive wheel 28 while the abutment 17a of the actuating member 17 contacts the end 32a of the positioning member 32 to pivot the latter from the inoperative position towards the operative position against the resiliency of the leaf spring portion 34a. As soon as the movable plate 16 is moved to the attracted position, the finger 32b on the positioning member 32 being pivoted from the inoperative position towards the operative position is engaged into a dale between any adjacent two of the detent gear teeth 20a on the carrier wheel 19, thereby avoiding any possible over-run of the carrier wheel 19.

At the same time, the pawl 26a is engaged into a dale between any adjacent two of the ratchet gear teeth 20b to avoid any possible reverse rotation of the carrier wheel 19.

Subsequent interruption of the supply of an electric current to the electromagnetic coil 13 results in release of the movable plate 16 from the attracted position. During the movement of the movable plate 16 from the attracted position back towards the released position as biased by the tension spring 18, the drive wheel 28 with the pin 31 engaged to the actuating member 17 is rotated in the second direction opposite to the first direction on one hand and the positioning member 32 is caused to pivot from the operative position back to the inoperative position by the action of the resiliency of the leaf spring portion 34a of the base plate 34 on the other hand. Even though the arcuate pawl 30 slidingly sweep the nest succeeding ratchet gear tooth during the rotation of the drive wheel 28 in the second direction, the pawl 26a serves to avoid the reverse rotation of the carrier wheel 19 and, therefore, the rotation of the drive wheel 28 in the second direction does not affect the position of the carrier wheel 19.

With the electromagnetic relay switch assembly being operable in the manner described above, it will readily be seen that, so far as the illustrated embodiment is involved, the fixed contacts on the terminal member 35 are electrically connected together through the movable contact disc 24 each time the carrier wheel 19 is stepwisely rotated through an angle of 120° about the bearing shaft 25. In other words, each three 40° stepwise rotation of the carrier wheel 19 is required to connect the fixed contacts to each other through the movable contact disc 24 so far as the illustrated embodiment is involved. However, the number of the ratchet gear teeth 20b and, hence, the number of the detent gear teeth 20a, is not limited to nine such as described and shown, but may be selected according to a particular specification of the electromagnetic relay switch assembly.

Although the present invention has fully been described in connection with the preferred embodiment thereof with reference to the accompanying drawings, it is to be noted that various changes and modifications are apparent to those skilled in the art. By way of example, although the detent member 26 has been described as mounted on the bearing shaft 25, it may be rigidly secured to the upright wall 10c, in which case the flange 25a may be omitted. In addition, the terminal member 35 is so designed as to be biased by a spring element towards the movable contact disc 24, the movable contact disc 24 may be integrally formed with the carrier wheel 19 with the compression spring 36 omitted.

Furthermore, instead of the employment of the leaf spring portion 34a, any spring element such as a tension spring or a compression spring may be employed.

Accordingly, such changes and modifications are to be understood as included within the true scope of the present invention unless they depart therefrom.

We claim:

1. An electromagnetic relay switch assembly which comprises, in combination:

an electromagnet unit including an electromagnetic coil means, a movable plate member of a magnetizable material supported for pivotal movement between attracted and released positions, said movable plate member being pivoted to the attracted and released positions, respectively, when the electromagnetic coil means is electrically energized and when said electromagnetic coil means is electrically deenergized, and a spring member for biasing the movable plate member to the released position;

a support shaft;

a drive wheel including a pawl member rigidly carried thereby, said drive wheel being mounted on the support shaft for rotation thereabout between first and second positions;

means operatively coupled to the movable plate member for transmitting the movement of the movable plate member to the drive wheel;

a carrier wheel stepwisely rotatably mounted on the support shaft and including a detent gear and a ratchet gear, said detent gear being constituted by its teeth being formed on the outer periphery of the carrier wheel and circumferentially equally spaced from each other, said ratchet gear being formed on one of the opposed surfaces of the carrier wheel adjacent the drive wheel and having teeth equal in number to the number of the teeth of the detent gear, said pawl member in the drive wheel being resiliently engaged in one of the teeth of the ratchet gear for rotating the carrier wheel stepwisely in one direction each time the drive wheel is rotated from the first position to the second position in response to the movement of the movable plate member from the released position to the attracted position;

means for avoiding any possible reverse rotation of the carrier wheel in a direction opposite to said one direction of the stepwise rotation of the carrier wheel;

means operable in response to the movement of the movable plate member from the released position towards the retracted position for avoiding any possible over-run of the carrier wheel beyond a distance exceeding the pitch between every adjacent two of the teeth of the ratchet gear;

a movable contact member mounted on the support shaft and coupled to the carrier wheel for rotation together therewith; and a fixed terminal means having at least one pair of fixed electroconductive contacts adapted to be electrically connected to each other when the movable contact member is brought in position to bridge said fixed contacts.

2. An assembly as claimed in claim 1, wherein said over-run avoiding means comprises a generally elongated positioning member pivotally supported at a substantially intermediate portion thereof for movement between operative and inoperative positions and having a first end engageable with said transmitting means and the other end engageable with any one of the teeth of the detent gear, and a spring element for biasing the positioning member to the inoperative position with said second end disengaged from the teeth of the detent gear, said positioning member, when the movable plate member is pivoted to the attracted position, pivoting to the operative position with the first end thereof held in contact with the transmitting means on one hand and with the second end thereof engaged with the corresponding tooth of the detent gear.

3. An assembly as claimed in claim 1 or 2, wherein said transmitting means comprises a generally elongated actuating member having one end rigidly connected to the movable plate member and having an engagement hole defined therein, and a pin member rigidly carried by the drive wheel and engaged in said engagement hole.

4. An assembly as claimed in claim 1 or 2 further comprising a compression spring interposed between the carrier wheel and the movable contact member for urging the latter towards the fixed terminal member.

5. An assembly as claimed in claim 1 or 2, wherein said reverse rotation avoiding means comprises a pawl member engageable to any one of the teeth of the ratchet gear.

* * * * *